United States Patent [19]

Fencl

[11] Patent Number: 4,472,959

[45] Date of Patent: Sep. 25, 1984

[54] REMOVABLE MULTI-DIE CARTRIDGE FOR SHRINK FORMING MACHINE

[75] Inventor: Vernon R. Fencl, Northbrook, Ill.

[73] Assignee: Grotnes Metalforming Systems, Inc., Chicago, Ill.

[21] Appl. No.: 348,859

[22] Filed: Feb. 16, 1982

[51] Int. Cl.[3] ..... B21D 41/00

[52] U.S. Cl. ..... 72/402; 72/481

[58] Field of Search ..... 72/402, 452, 355, 393, 72/41, 481

[56] References Cited

U.S. PATENT DOCUMENTS 3,461,710 8/1969 Luedi et al. ..... 72/372

4,309,892 1/1982 Currie ..... 72/402

OTHER PUBLICATIONS

Grotnes Metalforming Systems, Inc., "The Uncommon Approach", 1980, pp. 26–37.

*Primary Examiner*—Francis S. Husar

*Assistant Examiner*—Linda McLaughlin

*Attorney, Agent, or Firm*—Marshall, O'Toole, Gerstein, Murray & Bicknell

[57] ABSTRACT

A removable cartridge for insertion in a shrink forming machine having a multiplicity of circumferentially arranged radially movable machine jaws. The cartridge fits inside the machine jaws and is insertable and removable as a unit. The cartridge comprises a multiplicity of circumferentially arranged, radially movable cartridge jaws each engaged by a respective machine jaw to move the cartridge jaw inwardly. A die is mounted on the radially inward end of each cartridge jaw. Guidance structure protects against any substantial deviation by the die from a precise radial path of movement. Structure is provided to enable the cartridge jaw to absorb the load, developed during a shrink forming operation, within the limits of the relatively commonplace physical properties of the material of which the cartridge jaw is composed.

21 Claims, 11 Drawing Figures

REMOVABLE MULTI-DIE CARTRIDGE FOR SHRINK FORMING MACHINE

BACKGROUND OF THE INVENTION

The present invention relates generally to machines for cold forming metal and more particularly to machines for shrink forming metal workpieces.

Shrink forming machines are utilized to decrease the exterior diameter of a tubular workpiece, for example. A shrink former comprises a multiplicity of circumferentially arranged jaws mounted for movement in a radial direction. Located at the radial inward end of each jaw is a die for engaging the exterior surface of the workpiece. Each of the jaws is urged radially inwardly simultaneously, by a hydraulic mechanism, for example. This causes the dies to exert a radially inwardly directed pressure on the exterior of the tubular workpiece, causing metal flow in the workpiece and resulting in a decrease in the exterior diameter of the workpiece. This is usually accompanied by a corresponding increase in the axial dimension of the workpiece to accommodate the displacement of metal arising from the reduction in its exterior diameter. When a tubular workpiece undergoes shrinking, an interior mandrel may be employed to determine the internal diameter of the workpiece, and the external diameter of the workpiece is determined by the extent to which the dies are moved radially inwardly during the shrinking operation.

One type of shrink forming machine is disclosed in Luedi et al. U.S. Pat. No. 3,461,710, and the disclosure therein is incorporated herein by reference.

Shrink forming machines operate on a variety of workpieces having differing initial and final dimensions. A change in the workpiece often requires a change in the dies which perform the shrinking operation on the workpiece, and changing the dies in the shrink forming machine can be a tedious and time-consuming operation. This, in turn, results in substantial shut-down time for the shrink forming machine, which is undesirable.

An important consideration in shrink forming is that the die face must engage the workpiece at a predetermined location and maintain the engagement at that location all during the time the die moves radially inwardly during the shrink forming operation. To accomplish this, it is necessary that the die be carefully guided along a precise radial path during the entirety of its radially inward movement, and any substantial deviation from this path by the die during inward movement is undesirable.

In some conventional shrink forming machines, the die is guided by a key and keyway structure which guides the radially moving machine jaw to which the die is attached, but this guidance occurs at a location which is relatively radially remote from the die face which bears against the workpiece. Thus, a relatively insubstantial deviation at the guidance location is magnified progressively as the radial distance from the guidance location increases in a radially inward direction toward the die face. As a result, a minor clearance between the key and the keyway, or other minor imperfection on the guidance structure causing a relatively insubstantial deviation at the guidance location, can be magnified into a relatively large deviation at the radially remote location where the die face engages the workpiece.

Another problem which occurs in shrink forming arises from the fact that, at the location where the die face contacts the workpiece, very large stresses are developed. The die is made of an expensive alloy material which can withstand this stress, but the shrink forming machine itself, of necessity, is made of a less expensive material which is weaker than the material of which the die is composed. The stresses which are developed at the location where the die contacts the workpiece are transferred from the die through the jaws to the machine. Consequently, provision must be made for the machine to withstand the tremendous stresses which are developed at the die face.

SUMMARY OF THE INVENTION

To facilitate the rapid replacement of dies in the shrink forming machine, there is provided, in accordance with the present invention, a removable cartridge which is adapted to contain a complete set of detachable dies, for any given operation, and which may be removed or emplaced in the machine as a unit.

The cartridge is annular and comprises a multiplicity of cartridge jaws arranged circumferentially around the opening of the annulus. Each jaw has radially inward and outward ends, and a pair of sides, each extending between the ends. The cartridge jaws are mounted in the cartridge for movement in radially inward and outward directions. A die may be detachably or integrally mounted at the radially inward end of each cartridge jaw.

When the cartridge is emplaced in the shrink forming machine, each cartridge jaw is engageable by a radially moveable jaw on the shrink forming machine for translating radially inward movement by the machine jaws into radially inward movement by the cartridge jaws for moving the dies attached to the cartridge jaws radially inward to deform a tubular workpiece which extends axially through the opening in the center of the annular cartridge.

The entire cartridge, with its dies, is readily removable, as a unit, from the shrink forming machine. Once this has been done, another cartridge containing another set of dies can be readily inserted into the machine and attached in place.

The cartridge which has been removed from the machine can be held in reserve with the dies already in it remaining in place or the dies therein can be replaced by another set of dies, but this does not entail shutting down the shrink forming machine since that machine already includes another cartridge with fully operable dies therein.

The cartridge is provided with guide means extending in a radial direction, for each cartridge jaw, and these guide means extend at least a major part of the distance between the inward and outward ends of the cartridge jaw. As a result, guidance occurs relatively close to the radially inward location where the die face engages the surface of the workpiece, regardless of how remote from that location may be the radial guidance structure for the machine jaw. Therefore, a minor clearance or other minor imperfection on the guide means, causing a minor deviation from the guide path at the guidance location is not magnified into a substantial deviation at the die face, during the latter's radially inward movement.

The cartridge is used with a die having a radially inward end with a relatively small area for engaging the workpiece and a radially outward end having a relatively large area. The radially inward end of the cartridge jaw has a relatively large area corresponding to the area of the radially outward end of the die, and this radially inward end of the cartridge jaw receives the stress from the die. The radially outward end of the cartridge jaw has a relatively large area, substantially at least as large as the area of the radially inward end of the cartridge jaw and transfers, to a machine jaw, the stress received by the cartridge jaw from the die.

The cartridge jaw and the machine jaw are each composed of a steel material substantially less expensive than the material from which the die is composed and have inferior physical properties compared to the die. However, because of the relatively large area at the surface where the stress is transferred from the die to the cartridge jaw, compared to the area at the surface where the stress is transferred from the workpiece to the die, the cartridge jaw is able to withstand the load transferred to it even though it has inferior physical properties compared to the material of which the die is composed. Similarly, because the stress-receiving surface on the machine jaw has an area as large as the stress-receiving and transferring surfaces on the cartridge jaw, the machine jaw is similarly able to withstand the load transferred to it.

Other features and advantages are inherent in the structure claimed and disclosed or will become apparent to those skilled in the art from the following detailed description in conjunction with the accompanying diagrammatic drawings.

DETAILED DESCRIPTION

Figure 1:
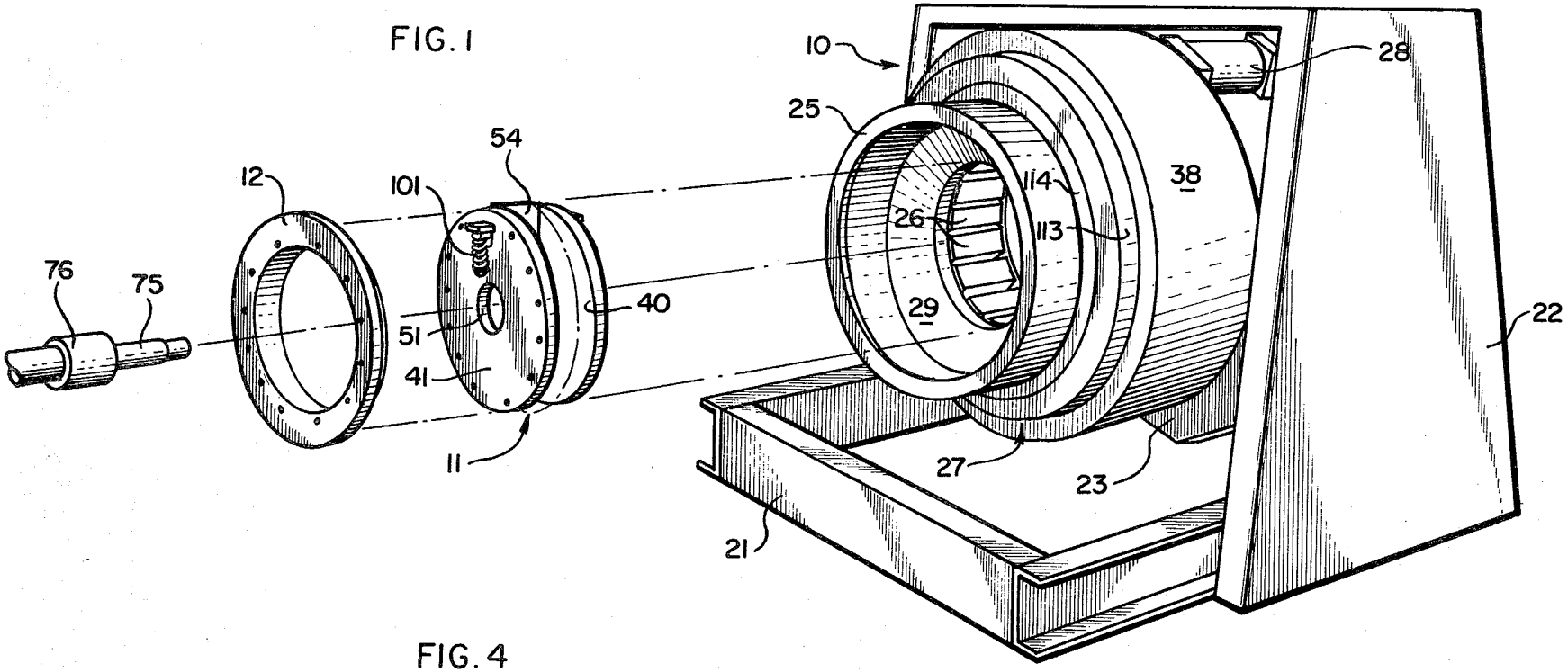
FIG. 1 is an exploded perspective of one embodiment of a shrink forming machine and one embodiment of a removable cartridge constructed in accordance with the present invention.
Figure 4:
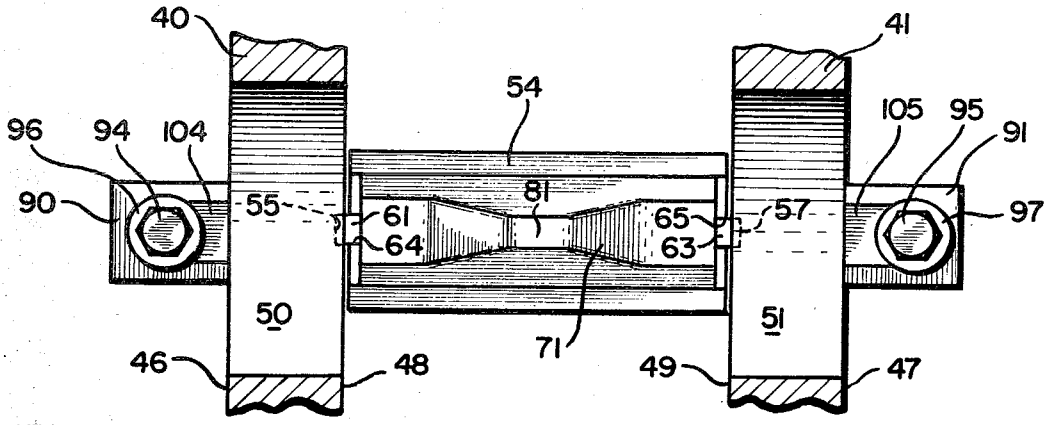
FIG. 4 is a sectional view taken along lines 4—4 in FIG. 2.

Referring initially to the embodiment of FIGS. 1-4, indicated generally at 10 in FIG. 1 is a shrink forming machine for use with a removable cartridge indicated generally at 11 and held in place within the shrink forming machine 10 by inner and outer clamping rings, the outer clamping ring being indicated at 12. Cartridge 11 is one embodiment in accordance with the present invention.

Figure 2:
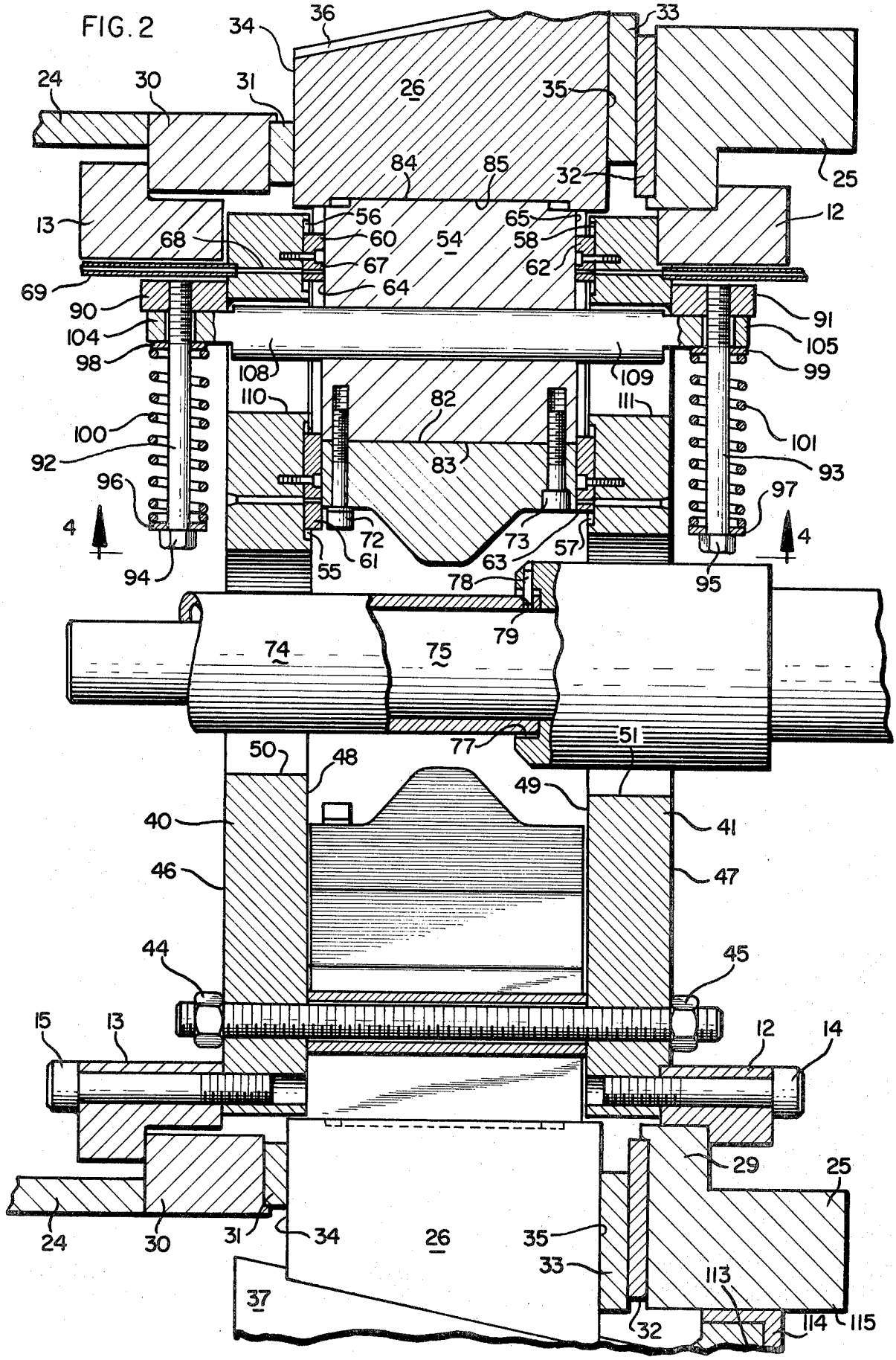
FIG. 2 is a fragmentary sectional view illustrating the removable cartridge of FIG. 1 positioned within the shrink forming machine.
Figure 3:
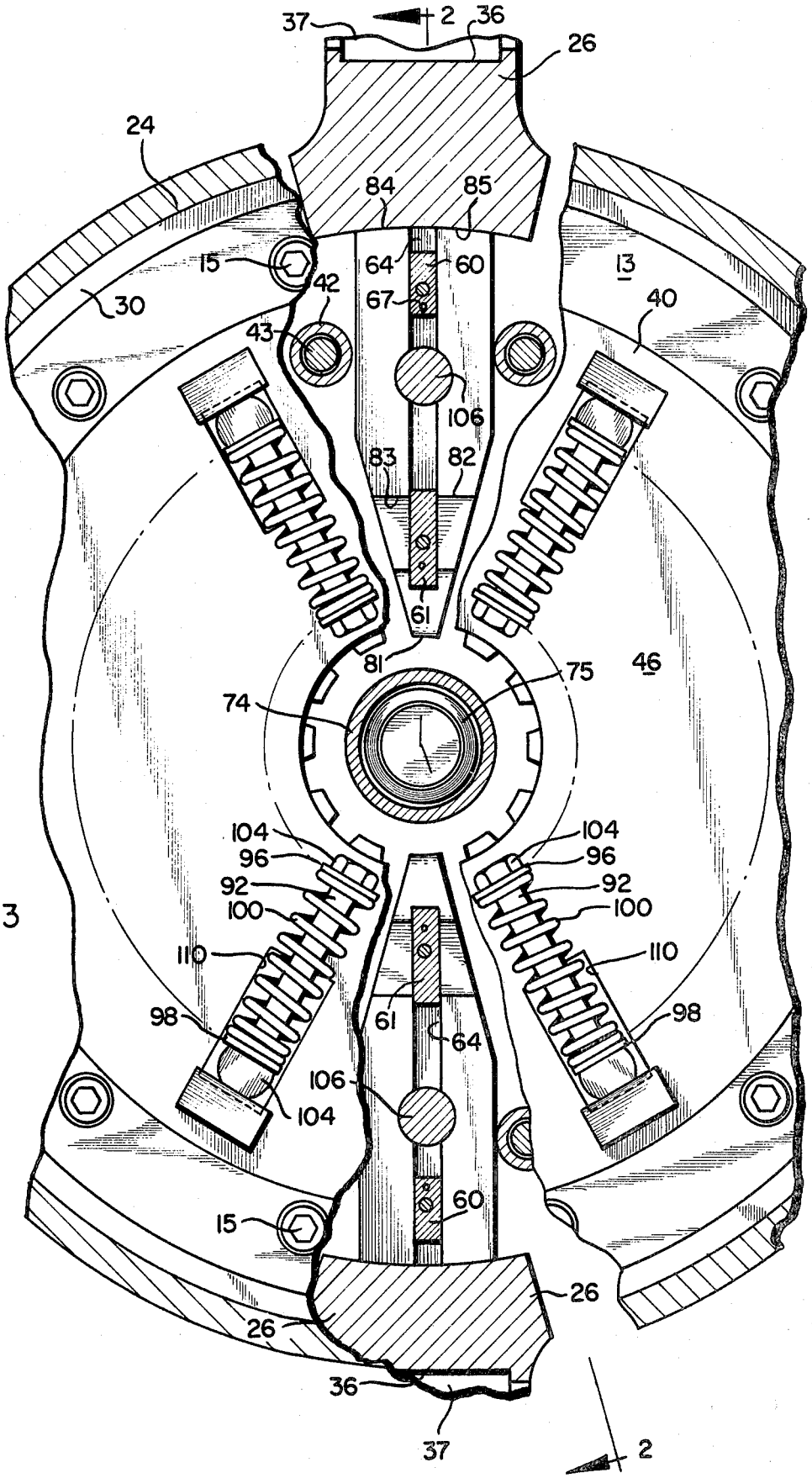
FIG. 3 is an end view of the removable cartridge as seen from inside the shrink forming machine.

Referring now to FIGS. 1 and 2, shrink forming machine 10 comprises a base 21 and an upright frame portion 22. Mounted within upright frame portion 22, near the rear thereof, is an annular support member 23, and extending forwardly from support member 23 is a tubular body or housing 24 (FIG. 2). Attached to the forward end of tubular body 24 is a mouth ring 25. Located within tubular body 24 are a multiplicity of circumferentially arranged machine jaws 26 mounted for radial movement relative to the rest of machine 10. Machine jaws 26 are moved radially inwardly and outwardly by a forwardly and rearwardly moving pressure ring assembly indicated generally at 27 in FIG. 1. Ring assembly 27 is actuated by a plurality of hydraulic cylinders 28 (one of which is shown in FIG. 1) arranged circumferentially around annular support member 23 and extending forwardly therefrom.

A more detailed description of those components of shrink forming machine 10 discussed above may be found in the aforementioned Luedi et al. U.S. Pat. No. 3,461,710.

Removable die cartridge 11 is inserted within machine 10 in the circular opening defined by machine jaws 26 (FIG. 2).

The structure mounting machine jaws 26 for radial movement within machine 10 will now be described. Connected to tubular body 24 is a shoulder ring 30, and mounted on shoulder ring 30 is an inner bronze ring 31 for slidably engaging an inner side 34 of machine jaw 26. Mounted on mouth ring 25 is an outer bronze ring 32 for slidably engaging a wear plate 33 mounted on the outer side 35 of machine jaw 26. The radially outermost end of each machine jaw 26 has a channel 36 for slidably receiving a wedge block 37 connected to the outer ring 38 of pressure ring assembly 27 and thus movable in forward and rearward directions by hydraulic cylinders 28. More particularly, when the pistons in hydraulic cylinders 28 push outer ring 38 forwardly (toward mouth ring 25), wedge blocks 37 are urged to the right as viewed in FIG. 2, causing the machine jaw 26 engaged by that wedge block to be urged radially inwardly along its slidable mountings between inner and outer bronze rings 31, 32. Conversely, when the pistons in hydraulic cylinders 28 pull outer ring 38 toward support member 23 (FIG. 1), wedge blocks 37 are retracted to the left as viewed in FIG. 2, in turn causing the corresponding machine jaw 26 to retract radially outwardly in its slidable mountings.

The foward end of each wedge block 37 (to the right in FIG. 2) is connected to a ring 113 on which is mounted a bearing ring 114 which slides on the outer surface 115 of mouth ring 25 during forward and rearward movement of wedge block 37.

The details of removable cartridge 11 and its mounting within shrink forming machine 10 will now be described.

Cartridge 11 comprises an inner circular plate 40 and an outer circular plate 41 maintained in spaced relationship by a plurality of spacer tubes 42 through each of which extends a bolt 43. At each end of bolt 42 is a nut 44, 45, each located on the outside of a respective plate, 40, 41. Plates 40, 41 have respective outer surfaces 46, 47 and respective inner surfaces 48, 49. Plates 40, 41 are disposed in parallel relationship and have axially aligned circular openings 50, 51, respectively.

Located between plates 40, 41 are a multiplicity of circumferentially arranged cartridge jaws 54, each of which is mounted for sliding radial movement relative to plates 40, 41 utilizing slidable mounting structure which will now be described.

Located on inner surface 48 of inner plate 40, are a pair of radially spaced recesses 55, 56. A similar pair of radially spaced recesses 57, 58 are located on the inner surface 49 of outer plate 41. Fastened within each of recesses 55–58 is a respective bronze key 60–63. Each cartridge jaw 54 has a pair of keyways 64, 65, each located on a respective opposite side of a cartridge jaw and each extending in a radial direction. Keys 60, 61 on inner plate 40 are slidably received within keyway 64 on one side of cartridge 54, and keys 62, 63 on outer plate 41 are slidably received within keyway 65 on the other side of cartridge jaw 54. The arrangement consisting of keys 60–63 and keyways 64, 65 mounts the cartridge jaw 54 for slidable movement in a radial direction relative to plates 40, 41 and also constitutes guidance structure for the cartridge jaw.

When the cartridge jaw is at the outer portion of its radial movement, keyways 64, 65 slidably engage primarily outer keys 60 and 62. When the cartridge jaw is at the inner portion of its radial movement, keyways 64, 65 engage primarily inner keys 61, 63. Thus the guidance structure for the cartridge jaw extend in a radial direction along each side of the jaw, at least a major part of the distance between the inward and outward ends 83, 84 thereof and provide positive guidance for the cartridge jaw along virtually its entire path of radial movement.

Because keys 60–63 are mounted within respective recesses 55–58 on plates 40, 41, rather than being mounted flush with the respective inner surfaces 48, 49 of the two plates, the keys are provided with additional structural support against non-radial shear forces parallel to plates 40, 41 and transferred to the keys from the keyways during a shrinking operation.

Each key 60–63 contains a lubricating channel 67 extending through the key for lubricating its corresponding keyway 64, 65. Each lubricating channel 67 communicates with a lubricating channel 68 extending through one of the plates 40, 41 and communicating with a lubricating conduit 69 located at the outer surface of the plate and connectable to a lubricant reservoir (not shown).

Fixed at the radially inward end 83 of each cartridge jaw 54, by bolts 72, 73, is a die 71 for deforming a tubular workpiece 74 located around a mandrel 75 which extends through circular openings 50, 51 in plates 40, 41 and positions workpiece 74 for shrinking. Mandrel 75 includes a shoulder 76 having, at one end thereof, a recess 77 for receiving an end portion of workpiece 74 which abuts against the inner surface of recess 77. Workpiece 74 is prevented from rotating about mandrel 75 by a pin 78 which extends radially from shoulder 76 into recess 77 and into an opening 79 extending through the wall of workpiece 74 in the end portion thereof received within recess 77.

Die 71 has a radially inward end 81 with a relatively small area for engaging workpiece 74. Die 71 also has a radially outward end 82 having a relatively large area compared to that of its inward end 81. Cartridge jaw 54 has a radially inward end 83 having a relatively large area substantially at least as large as the area of radially outward die end 82. Radially outward die end 82 transfers to cartridge jaw 54 the stress exerted on the die during the shrink forming operation. Cartridge jaw 54 also has a radially outward end 84 having a relatively large area substantially at least as large as the area of the cartridge jaw's radially inward end 83. End 84 of the cartridge jaw comprises means for transferring, to machine jaw 26, stress received by the cartridge jaw from die 71. Machine jaw 26 has a radially inward end 85 having an area substantially at least as large as the area of radially outward end 84 of the cartridge jaw, and radially inward end 85 of machine jaw 26 receives stress from the cartridge jaw.

Both cartridge jaw 54 and machine jaw 26 are composed of steel material having physical properties substantially inferior to the physical properties of the alloy from which die 71 is composed. However, because of the relatively large areas on machine jaw end 85, cartridge jaw ends 83, 84 and radially outward die end 82, compared to the area of inward die end 81, the jaws 54, 26 are able to withstand the stresses transferred to them from die 71 during a shrink forming operation. Although the total load transferred to jaws 54, 26 is the same as the total load exerted on die 71 by the workpiece, because the area of the transfer surfaces on jaws 54, 26 are relatively large compared to the area of die end 81 at which the load is transferred to the die, the stress, expressed as pounds per square inch, is substantially less on the transfer surfaces of the jaws than it is at radially inward end 81 on the die, and these transfer stresses are within the physical properties of the steel of which jaws 54 and 26 are composed.

As noted above, each of the jaws 54 is urged radially inwardly by radially inward movement of a machine jaw 26 in turn urged radially inwardly by the outward movement (to the right in FIG. 2) of a wedge block 37. When wedge block 37 is retracted inwardly (to the left in FIG. 2) it pulls machine jaw 26 radially outwardly. Cartridge jaw 54 is then returned in a radially outward direction by structure which normally urges cartridge jaw 54 radially outwardly, and this structure will now be described.

Connected to the outer surface 46, 47 of each plate 40, 41 is a respective block 90, 91. Threadedly engaging each block 90, 91 is a respective bolt 92, 93 extending radially inwardly from its respective block 90, 91 and terminating at a respective bolt head 94, 95. Located around bolts 92, 93 adjacent bolt heads 94, 95 are respective washers 96, 97 and located around bolts 92, 93 at a location spaced in a radially outward direction from washers 96, 97 are washers 98, 99.

Located around bolts 92, 93 are respective coil springs 100, 101. Coil spring 100 has a radially outer end abutting against washer 98 and a radially inner end abutting against washer 96. Similarly, coil spring 101 has a radially outer end abutting against washer 99 and a radially inner end abutting against washer 97. Each coil spring 100, 101 extends in a radial direction and is located adjacent the outer surface 46, 47 of a respective plate 40, 41. Each coil spring 100, 101 is disposed parallel to the direction of radial movement of the corresponding cartridge jaw 54.

Extending through cartridge jaw 54 is a shaft 106 having a pair of opposite end portions 108, 109, each of which extends through a respective slot 110, 111 in a respective plate 40, 41. Each end portion 108, 109 terminates at a respective necked-down part 104, 105, and each necked-down part 104, 105 is slidably mounted around a respective bolt 92, 93. In the case of necked-down part 104, it is located between block 90 and washer 98, and in the case of necked-down part 105, it is located between washer 99 and block 91.

Coil springs 100, 101 and their mounting arrangements normally urge the cartridge jaw connected thereto via shaft 106 to a radially outward position. When cartridge jaw 54 is urged radially inwardly, shaft 106 also moves radially inwardly, thereby compressing coil springs 100, 101. When machine jaw 26 is retracted upwardly, this releases the force holding coil springs 100, 101 in their compressed condition and they expand to the normally uncompressed condition shown in FIG. 2, in turn urging shaft 106 and cartridge jaw 54 in a radially outward direction.

As previously noted, cartridge 11 is held in place within shrink forming machine 10 by outer and inner clamping rings 12, 13, respectively. Outer ring 12 abuts against a radially inwardly extending flange 29 on mouth ring 25 and is secured to outer cartridge plate 41 by bolts 14. Inner ring 13 abuts against shoulder ring 30 and is secured to inner cartridge plate 40 by bolts 15. Removal of cartridge 11 from machine 10 is effected by unbolting inner clamp ring 13 from plate 40 and withdrawing the cartridge from the machine in an axially forward direction (to the right in FIG. 2). Outer clamping ring 12 need not be unbolted to remove the cartridge from the machine, and the circumferential arrangement of the cartridge jaws is not disturbed by removal of the cartridge from the machine.

Figure 5:
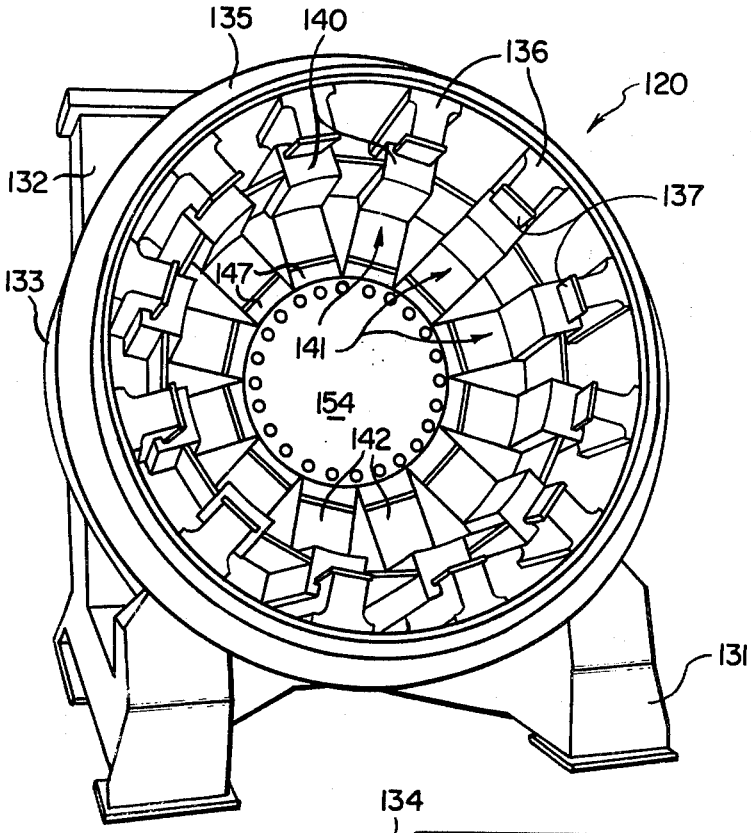
FIG. 5 is a perspective of another embodiment of a shrink forming machine.
Figure 6:
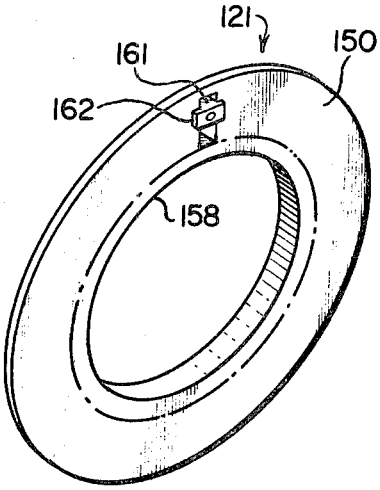
FIG. 6 is a perspective of another embodiment of a removable cartridge constructed in accordance with the present invention and intended for use with the shrink forming machine of FIG. 5.
Figure 7:
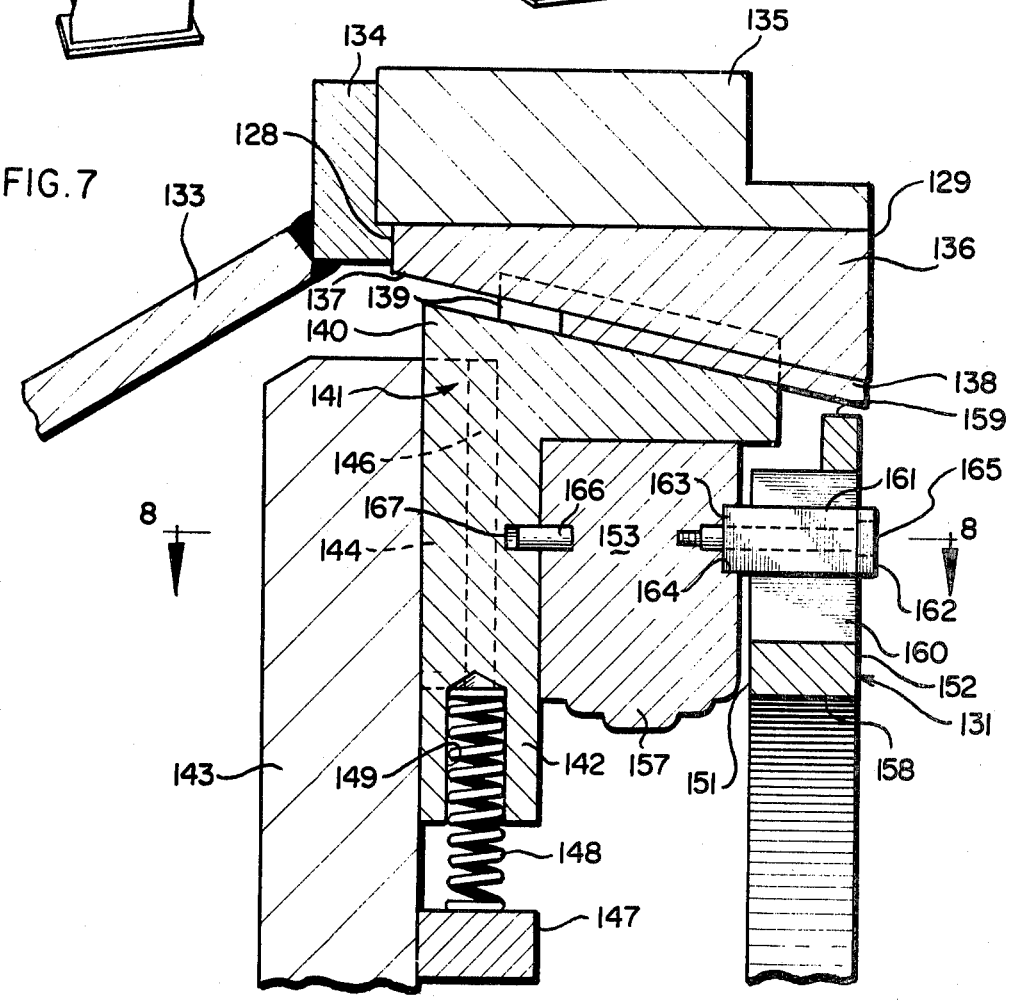
FIG. 7 is a fragmentary sectional view showing the cartridge of FIG. 6 installed in the shrink forming machine of FIG. 5.
Figure 8:
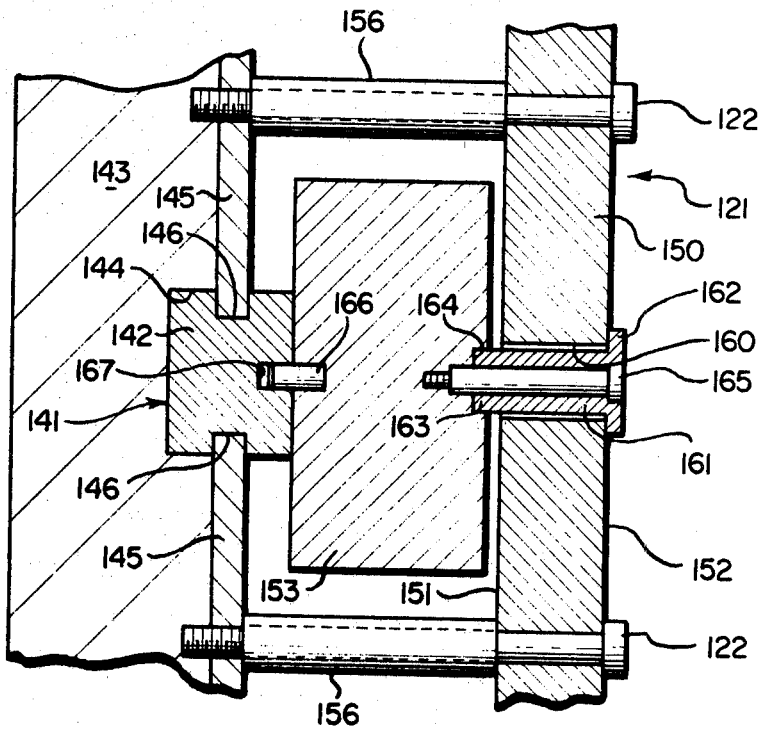
FIG. 8 is a sectional view taken along line 8—8 in FIG. 7.
Figure 9:
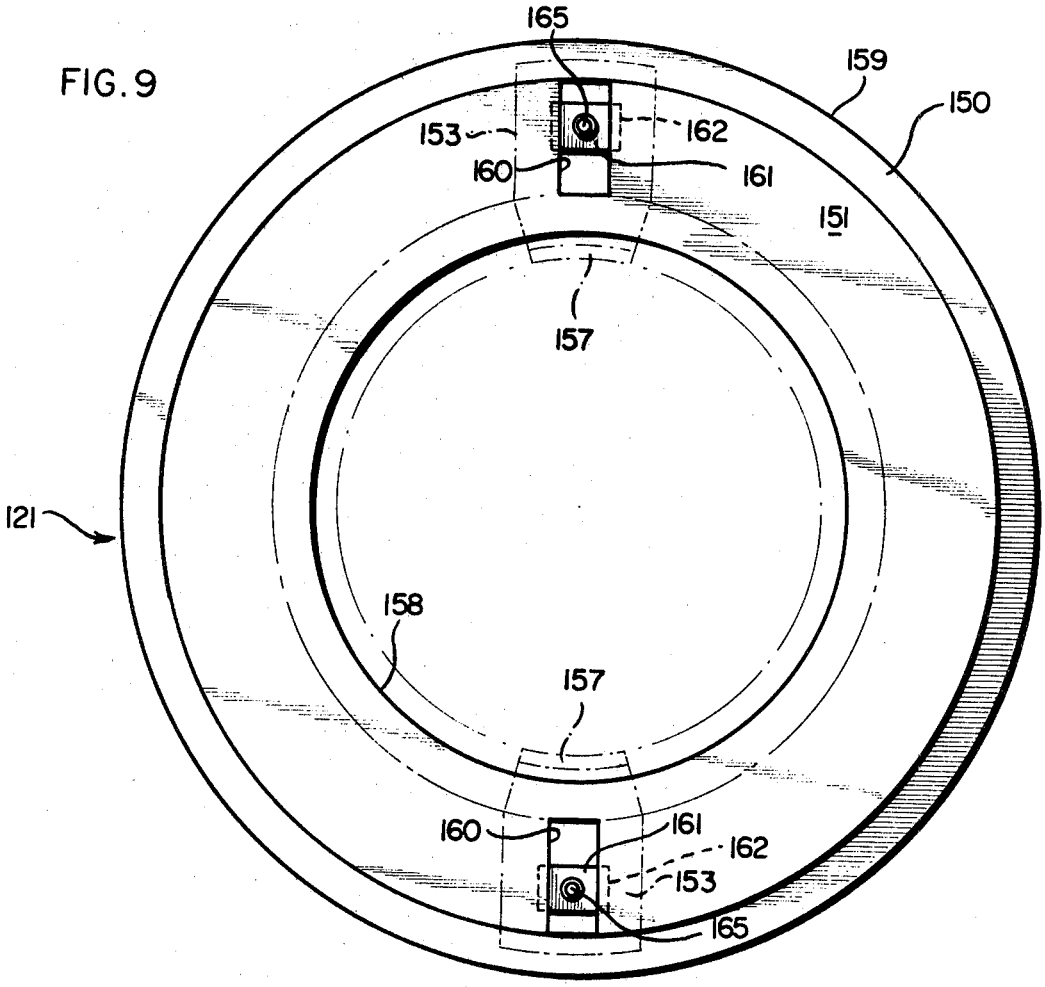
FIG. 9 is a rear view of the cartridge of FIG. 6.

Referring now to the embodiment of FIGS. 5–11, indicated generally at 120 in FIG. 5 is a shrink-forming machine for use with a removable cartridge indicated generally at 121 and held in place on shrink-forming machine 120 by a plurality of attachment bolts 122, 122 (FIG. 8). Cartridge 121 is another embodiment in accordance with the present invention.

As shown in FIGS. 5 and 7, shrink-forming machine 120 comprises a base 131 and an upright frame portion 132 located at the rear of the machine. Extending frontwardly from upright frame portion 132 is a frusto-conical support member 133, and attached at the front end of member 133 is a ring assembly 134, 135. Attached to the inside of ring member 135 are a multiplicity of circumferentially arranged blocks 136, 136, each having a respective inner surface 137 which slopes radially inwardly from its rearward end 128 to its frontward end 129. Attached to each inner block surface 137 is a key-plate 138 which is received within and engaged by a T-slot 139 in the radially outward portion 140 of a machine jaw 141 having a tail portion 142 extending radially inwardly from machine jaw outer portion 141. Tail portion 142 is mounted for slidable movement in radially inward and outward directions on an end plate or table 143 located behind circumferentially arranged machine jaws 141.

Circumferentially arranged blocks 136 define a circular opening in front of machine jaws 141, 141, and removable die cartridge 121 is inserted within this opening.

Structure for guiding machine jaws 141, 141 in radially inward and outward directions is illustrated in FIGS. 7 and 8. More particularly, for each machine jaw 141, there is, on end plate 143, a radially extending recess 144 for receiving tail portion 142 of the machine jaw. Mounted on end plate 143, on each side of recess 144, and slightly overlapping recess 144, are gibs 145, 145 each of which slidably engages within a respective one of a pair of slots 146, 146 extending in a radial direction on each side of tail portion 142.

Machine jaws 141 are moved radially inwardly and outwardly in response to the movement of end plate 143 in frontward and rearward directions (to the right and left respectively, as viewed in FIG. 7). End plate 143 is moved by conventional hydraulic cylinder means (not shown) mounted on upright frame portion 132 and extending between frame portion 132 and end plate 143.

Machine jaws 141, 141 are urged radially inwardly in the following manner. Because the machine jaws are carried on end plate 143, when the end plate is urged frontwardly (to the right in FIG. 7), each machine jaw slides frontwardly in its slidable mounting on a respective block 136. As noted above, this slidable mounting comprises key-plate 138 on block 136 and T-slot 139 in the machine jaw's radially outward portion 140. Because the block's inner surface 137 is sloped in a radially inward direction, from rear to front, and because key-plate 138 follows this slope, as a machine jaw 141 slides frontwardly in relation to its respective block 136, the machine jaw is simultaneously urged radially inwardly.

When end plate 143 is moved rearwardly (to the left in FIG. 7), it carries each machine jaw 141 with it. The engagement between key-plate 138 on machine block 136 and T-slot 139 on machine jaw 141 causes the machine jaw to be retracted radially outwardly as the machine jaw moves rearwardly.

Figure 10:
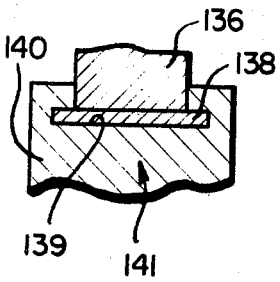
FIG. 10 is a fragmentary sectional view illustrating a portion of the shrink forming machine and cartridge.
Figure 11:
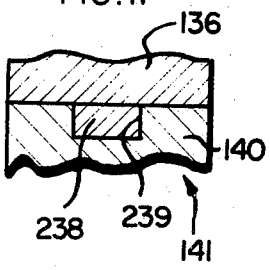
FIG. 11 is a fragmentary sectional view similar to FIG. 10, illustrating another embodiment of the structure of FIG. 10.

In lieu of the relatively wide key-plate and T-slot arrangement 138, 139 shown in FIG. 10, machine block 136 may be provided with a narrow key element 238, and the machine jaw 141 may be provided with a narrow channel shaped slot 239 for receiving key element 238, as shown in FIG. 11. With the slide arrangement 238, 239 shown in FIG. 11, rearward movement of machine jaw 141 along its slidable mounting on block 136 will not automatically retract machine jaw 141 radially outwardly. In such a case additional retracting structure must be provided, and such structure is shown in FIG. 7.

More particularly, attached to the front surface of plate 143, below a location disposed radially inwardly of each machine jaw 141 is a ledge 147 supporting a coilspring 148 extending into an opening 149 in tail portion 142 of the machine jaw. As a machine jaw 141 is urged radially inwardly, it compresses coil spring 148, which normally urges the machine jaw in a radially outward direction. Coil spring 148 causes machine jaw 141 to be retracted radially outwardly in response to a rearward movement of end plate 143 and machine jaws 141.

There is a multiplicity of ledges 147, 147, one for each machine jaw. As shown in FIG. 5, ledges 147, 147 may have attached thereto a cover plate 154.

Although the retracting structure 147–149 is illustrated in FIG. 7 as being used together with the key plate and T-slot arrangement 138, 139 shown in FIG. 10, the use with the latter of retracting structure 147–149 is optional. However, with respect to the slide arrangement 238, 239 shown in FIG. 11, some additional retracting structure, such as that shown at 147–149, is necessary.

The details of removable cartridge 121 and its mounting on shrink forming machine 120 will now be described. Referring to FIGS. 6–9, cartridge 121 comprises a plate 150 having respective inner and outer surfaces 151, 152. Mounted on inner plate surface 151 are a multiplicity of circumferentially arranged cartridge jaws 153, 153. As previously indicated, cartridge 121 is mounted on shrink forming machine 120 by bolts 122, 122 (FIG. 8). Each bolt 122 extends through cartridge plate 150, through a spacer tube 156, through a gib 145 and into end plate 143 on the shrink forming machine. Spacer tubes 156, 156 maintain cartridge plate 150 at a predetermined spacing from end plate 143.

Each cartridge jaw 153 includes, as an integral part thereof, a die portion 157. Optionally, the die portion may be made separate and discrete from the cartridge jaw, in a manner similar to that in the embodiment illustrated in FIGS. 1–4 (i.e., a separate die 71 attached by bolts 72, 72 to a cartridge jaw 54).

Plate 150 includes a centrally disposed, circular opening 158 which provides access for a workpiece or tooling to be located within the circumferentially arranged die portions 157, 157 on jaws 153, 153.

Each circumferentially arranged cartridge jaw 153 is mounted for sliding radial movement relative to plate 150 utilizing slidable mounting structure which will now be described. Located between plate opening 158 and the outside rim 159 of plate 150 are a multiplicity of radially extending slots 160, 160 there being one slot 160 for each cartridge jaw 153. Extending through slot 160 is a T-block 161 having a head portion 162 engaging the outside surface 152 of cartridge plate 150 on each side of slot 160. T-block 161 terminates at an end portion 163, opposite T-block head portion 162, and end portion 163 is received within a recess 164 in cartridge jaw 153. A bolt 165 extends through T-block 161 to attach the T-block to cartridge jaw 153.

As the cartridge jaw moves radially inwardly and outwardly, T-block 161 slides in a radial direction within slot 160. The slot and T-block arrangement at 160, 161 constitutes structure for removably mounting cartridge jaw 153 for slidable movement on the inside surface 151 of cartridge plate 150 as well as constituting radial guiding structure for the cartridge jaw.

Cartridge jaw 153 is connected to the tail portion 142 of machine jaw 141 by a pin 166 fixed to cartridge jaw 153 and removably received within a hole 167 in tail portion 142 of the machine jaw. Because of the connection between cartridge jaw 153 and machine jaw 141 at 166, 167, movement in a radial direction by machine jaw 141 causes similar movement by cartridge jaw 153. Thus, when machine jaw 141 moves radially inwardly during a shrinking operation, cartridge jaw 153 undergoes similar movement, and when machine jaw 141 is retracted radially outwardly, cartridge jaw 153 undergoes a similar retraction.

Hole 167 in machine jaw 141 extends in a direction which is parallel to the axis of shrink-forming machine 120 and its circumferentially arranged machine jaws 141, 141. Similarly, pin 166 extends in the same axially parallel direction. The mounting of cartridge 121 on machine 120 is effected by axially aligning the cartridge with the machine jaws, and moving the cartridge in a direction parallel to that axis. When the cartridge is axially aligned with the machine jaws 141, 141, the circumferentially arranged cartridge jaws 153, 153 are coaxial with the machine jaws, and each pin 166 on a cartridge jaw 153 can be aligned with an opening 167 in a machine jaw 141. Thus, when the cartridge is moved rearwardly in a direction parallel to said axis (to the left in FIG. 7), each pin 166 will be received and engaged in an opening 167. Removal of the cartridge from the machine is effected merely by unloosening bolts 122, 122 and then moving the cartridge frontwardly in an axially parallel direction (to the right in FIG. 7). This causes a disengagement of pins 166 from holes 167, and the cartridge is removable from the machine without disturbing the circumferential arrangement of the cartridge jaws.

Shrink-forming machine 120 (FIG. 5) is a conventional type of shrink-former in which the workpiece and tooling can be inserted into the machine only from its front end, and cartridge 121 is intended for use with that type of shrink-forming machine. Shrink-forming machine 10 (FIG. 1) can receive a workpiece or tooling from either the front or the rear, and cartridge 11 is intended for use with this type of machine.

The foregoing detailed description has been given for clearness of understanding only, and no unnecessary limitations should be understood therefrom, as modifications will be obvious to those skilled in the art.

I claim:

1. A removable cartridge for use in conjunction with a machine for reducing the diameter of a metallic, cylindrical, tubular workpiece by shrink forming, wherein said machine has a multiplicity of machine jaws movable in radially inward and outward directions, said removable cartridge comprising:

plate means having an opening at a radially inward location on the plate means;

a multiplicity of circumferentially arranged cartridge jaws mounted on said plate means, each cartridge jaw having radially inward and outward ends;

means mounting said cartridge jaws for movement on said plate means in radially inward and outward directions relative to said opening in said plate means;

means on said cartridge jaws for engaging said machine jaws to translate radially inward movement by the machine jaws into radially inward movement by the cartridge jaws;

means engaging said cartridge jaws for effecting a retraction of said cartridge jaws in a radially outward direction in response to radially outward movement of the machine jaws;

means on each cartridge jaw for mounting a die at the radially inward end thereof;

and means, including said plate means, for mounting the entire cartridge, as a unit, in said machine and for permitting the removal from said machine of said entire cartridge as a unit.

2. A removable cartridge as recited in claim 1 and comprising:

guide means for each cartridge jaw, extending in a radial direction on at least one of said plate means or said cartridge jaw.

3. A removable cartridge as recited in claim 2 wherein:

each of said cartridge jaws has a pair of sides extending between said ends of the cartridge jaws;

said plate means comprises a pair of plates each having inner and outer surfaces;

spacer means for maintaining said plates in a predetermined spaced relation with said inner plate surfaces in mutually facing relation;

each of said cartridge jaws being located between said plates with a respective side of each cartridge jaw being disposed adjacent a respective inner plate surface;

said means mounting said cartridge jaws for radial movement and said radially extending guide means comprising key means on the inner surface of each plate and keyway means on each side of each cartridge jaw for slidably receiving a respective key means.

4. A removable cartridge as recited in claim 1 and comprising:

inside and outside surfaces on said plate means;

said mounting means for the cartridge jaws comprising means mounting the cartridge jaws on the inside surface of the plate;

and guide means comprising a radially extending slot in said plate means for each cartridge jaw and a guide element attached to the cartridge jaw, extending through said slot and engaging the outside surface of said plate means.

5. A removable cartridge as recited in claim 4 wherein said machine jaw-engaging means comprises:

a pin extending from said cartridge jaw in a direction parallel to the axis of said circumferentially arranged cartridge jaws, for engaging within a machine jaw hole extending in said axially parallel direction.

6. A removable cartridge as recited in claim 1 wherein said retracting means comprises:

means attached to each cartridge jaw for engaging a respective machine jaw.

7. A removable cartridge as recited in claim 1 wherein:

said plate means comprises a pair of plates each having inner and outer surfaces;

spacer means for maintaining said plates in a predetermined spaced relation with said inner plate surfaces in mutually facing relation;

each of said cartridge jaws being located between said plates with a respective side of each cartridge jaw being disposed adjacent a respective inner plate surface;

and said retracting means comprises means normally urging said cartridge jaws in a radially outward direction.

8. A removable cartridge as recited in claim 7 wherein said outward urging means comprises:

a pair of radially extending coil springs for each cartridge jaw;

means mounting each coil spring in a given pair adjacent the outer surface of a respective plate;

each of said coil springs in a given pair being disposed parallel to the direction of radial movement of the corresponding cartridge jaw;

each coil spring having radially outward and inward ends;

and means, connected to said cartridge jaw, engaging the radially outward end of each coil spring in the corresponding pair, for compressing said coil springs in response to radially inward movement by said cartridge jaw.

9. A removable cartridge as recited in claim 8 wherein:

said means engaging the coil springs comprises a shaft extending through said cartridge jaw;

and each of said plates comprises a radially extending slot through which extends a respective portion of said shaft;

said slot comprising means for accommodating movement of said shaft with said cartridge jaw in a radial direction.

10. A removable cartridge jaw as recited in claim 8 wherein said mounting means for a coil spring comprises:

a member extending through said coil spring in a radial direction;

said member having radially inward and outward ends;

means at said member's radially inward end engaging the radially inward end of said coil spring;

and means at said member's radially outward end connecting said member to the adjacent plate.

11. A removable cartridge as recited in claim 1 wherein said means for permitting said removal of the cartridge comprises:

means, including said plate means, for preventing said circumferential arrangement of the cartridge jaws from being disturbed during said removal.

12. A removable cartridge for use in conjunction with a machine for reducing the diameter of a metallic, cylindrical, tubular workpiece by shrink forming, wherein said machine has a multiplicity of machine jaws movable in radially inward and outward directions, said removable cartridge comprising:

plate means having an opening at a radially inward location on the plate means;

a multiplicity of circumferentially arranged cartridge jaws mounted on said plate means, each cartridge jaw having radially inward and outward ends and a pair of sides each extending between said ends;

means mounting said cartridge jaws for movement on said plate means in radially inward and outward directions relative to said opening in said plate means;

means on said cartridge jaws for engaging said machine jaws to translate radially inward movement by the machine jaws into radially inward movement by the cartridge jaws;

means on each cartridge jaw for mounting a die at the radially inward end thereof;

guide means extending in a radial direction along at least one side of each cartridge jaw;

and means, including said plate means, for mounting the entire cartridge, as a unit, in said machine and for permitting the removal from said machine of said entire cartridge as a unit.

13. A removable cartridge as recited in claim 12 wherein:

said guide means extends radially at least a major part of the distance between said inward and outward ends of the cartridge jaw.

14. A removable cartridge as recited in claim 8 wherein said cartridge is intended for use with a die having a radially inward end with a relatively small area for engaging a workpiece and a radially outward end having a relatively large area, and wherein:

said radially inward end of the cartridge jaw has a relatively large area corresponding to the area of the radially outward end of a die having a radially inward end with a relatively small area for engaging a workpiece and a radially outward end having a relatively large area, and said radially inward end of the cartridge jaw comprises means for receiving stress from said die;

said radially outward end of the cartridge jaw (a) has a relatively large area substantially at least as large as the area of said radially inward end of the cartridge jaw and (b) comprises means for transferring, to a machine jaw, stress received by the cartridge jaw from said die.

15. A removable cartridge as recited in claim 12 wherein:

said plate means comprises a pair of plates each having inner and outer surfaces;

spacer means for maintaining said plates in a predetermined spaced relation with said inner plate surfaces in mutually facing relation;

each of said cartridge jaws being located between said plates with a respective side of each cartridge jaw being disposed adjacent a respective inner plate surface;

said means mounting said cartridge jaws for radial movement and said radially extending guide means comprising key means on the inner surface of each plate and keyway means on each side of each cartridge jaw for slidably receiving a respective key means.

16. A removable cartridge as recited in claim 15 and comprising:

means normally urging said cartridge jaws in a radially outward direction.

17. A removable cartridge as recited in claim 16 wherein said outward urging means comprises:

a pair of radially extending coil springs for each cartridge jaw;

means mounting each coil spring in a given pair adjacent the outer surface of a respective plate;

each of said coil springs in a given pair being disposed parallel to the direction of radial movement of the corresponding cartridge jaw;

each coil spring having radially outward and inward ends;

and means, connected to said cartridge jaw, engaging the radially outward end of each coil spring in the corresponding pair, for compressing said coil springs in response to radially inward movement by said cartridge jaw.

18. A removable cartridge as recited in claim 17 wherein:

said means engaging the coil springs comprises a shaft extending through said cartridge jaw;

and each of said plates comprises a radially extending slot through which extends a respective portion of said shaft;

said slot comprising means for accommodating movement of said shaft with said cartridge jaw in a radial direction.

19. A removable cartridge jaw as recited in claim 17 wherein said mounting means for a coil spring comprises:

a member extending through said coil spring in a radial direction;

said member having radially inward and outward ends;

means at said member's radially inward end engaging the radially inward end of said coil spring;

and means at said member's radially outward end connecting said member to the adjacent plate.

20. A removable cartridge as recited in claim 12 wherein said means for permitting said removal of the cartridge comprises:

means, including said plate means, for preventing said circumferential arrangement of the cartridge jaws from being disturbed during said removal.

21. A combination for use in conjunction with a machine for reducing the diameter of a metallic, cylindrical, tubular workpiece by shrink forming, wherein said machine has a multiplicity of machine jaws movable in radially inward and outward directions, said combination comprising:

a removable cartridge comprising plate means having an opening at a radially inward location on the plate means;

a multiplicity of circumferentially arranged cartridge jaws mounted on said plate means, each cartridge jaw having radially inward and outward ends and a pair of sides each extending between said ends;

means mounting said cartridge jaws for movement on said plate means in radially inward and outward directions relative to said opening in said plate means;

means on said cartridge jaws engaging said machine jaws to translate radially inward movement by the machine jaws into radially inward movement by the cartridge jaws;

means on each cartridge jaw for mounting a die at the radially inward end thereof;

guide means extending in a radial direction along at least one side of each cartridge jaw;

means, including said plate means, for mounting the entire cartridge, as a unit, in said machine and for permitting the removal from said machine of said entire cartridge as a unit;

and a die for use with one of said cartridge jaws;

said die having a radially inward end with a relatively small area for engaging a workpiece and a radially outward end having a relatively large area engaging said radially inward end of the cartridge jaw;

said radially inward end of the cartridge jaw (a) having a relatively large area corresponding to the area of the radially outward end of the die and (b) comprising means for receiving stress from said die;

said radially outward end of the cartridge jaw (a) having a relatively large area substantially at least as large as the area of said radially inward end of the cartridge jaw and (b) comprising means for transferring, to a machine jaw, stress received by the cartridge jaw from said die.

* * * * *